US006527418B1

(12) United States Patent
Scherba

(10) Patent No.: US 6,527,418 B1
(45) Date of Patent: Mar. 4, 2003

(54) LIGHT COOLER

(75) Inventor: Robert J. Scherba, Richfield, OH (US)

(73) Assignee: Scherba Industries, Inc., Brunswick, OH (US)

( * ) Notice: Subject to any disclaimer, the term of this patent is extended or adjusted under 35 U.S.C. 154(b) by 0 days.

(21) Appl. No.: 09/524,220

(22) Filed: Mar. 13, 2000

Related U.S. Application Data

(63) Continuation of application No. 09/085,638, filed on May 27, 1998, now abandoned.
(60) Provisional application No. 60/047,728, filed on May 27, 1997.

(51) Int. Cl.[7] ..... F21V 29/00; F21V 15/00
(52) U.S. Cl. ..... 362/294; 362/257; 362/264; 362/362; 362/373
(58) Field of Search ..... 362/292, 293, 362/294, 101, 267, 276, 373

(56) References Cited

U.S. PATENT DOCUMENTS 4,321,659 A 3/1982 Wheeler
4,546,420 A 10/1985 Wheeler
5,051,875 A * 9/1991 Johnson ..... 362/267

* cited by examiner

*Primary Examiner*—Audrey Chang
(74) *Attorney, Agent, or Firm*—Fay, Sharpe, Fagan, Minnich & McKee

(57) ABSTRACT

An improved light fixture for an inflatable structure which includes a cooling arrangement which cools the light source in a light container. The cooling arrangement including a passageway which directs a cooling fluid into and out of the interior of the canister. The cooling arrangement includes blower to direct the cooling fluid toward the light source and a diffuser to distribute the cooling fluid about the light source. The cooling arrangement also includes a temperature monitor to monitor the temperature in the light container and to activate the blower upon detecting a predetermined temperature in the light container and/or to deactivate the light source upon detecting a predetermined temperature in the light container.

43 Claims, 4 Drawing Sheets

LIGHT COOLER

This patent application is a continuation application of U.S. patent application Ser. No. 09/085,638 filed May, 27, 1998 abandoned, and incorporated herein by reference. This invention claims priority on U.S. Provisional Application Serial No. 60/047,728 filed May 27, 1997 entitled Light Cooler.

BACKGROUND OF THE INVENTION

The present invention is particularly applicable to heat dissipation arrangements for illuminating devises used to illuminate inflatable objects and will be discussed with particular reference thereto; however, the invention has broader applications and may be used to dissipate heat in a wide variety of illuminating devices.

In the inflatable industry, it is a particular advantage to use inflatable devices for advertising purposes due to the eye-catching nature of the inflatables. The illumination of such inflatables during the night is also advantageous since the advertising can be visually seen at night and the illumination of such inflatables enhances the visual attraction of such inflatable thereby enhancing the value of the advertising promoted by such inflatables. However, the illumination of inflatables poses several challenging problems. Lights that are normally bright enough to effectively illuminate inflatables tend to radiate large amounts of heat. The heat from such lights can cause damage to the inflatable and/or cause damage to the inflatable if the inflatable were to deflate and come in contact with the hot surface of the light. The heat generated from the light can also adversely affect the operation of the light. A significant increase in temperatures of the light can result in the light filament prematurely burning out and/or the light casing becoming damaged, thereby resulting in a failure of the light. The high temperature resulting from the light can also adversely affect the electronics operating the light, thereby resulting in control problems and ultimately the failure of the light. The high temperature produced by the light also can hamper the rapid disassembly and packaging of the illuminated inflatable.

As a result, there is a need and demand in the inflatable industry for an effective illuminating device for inflatables which is safe and convenient to use and overcomes the problems associated with prior illumination devices.

SUMMARY OF THE INVENTION

The present invention relates to a light cooling system adapted to dissipate heat generated by an illumination source. The invention is particularly applicable to a light cooling system used to cool light sources for inflatables.

In accordance with the principles featured in the present invention, there is provided a light fixture designed to illuminate an inflatable structure. Such inflatable structures include balloons, advertising displays, recreational structures, and the like. The light fixture is designed so that it can be conveniently mounted on or within an inflatable to effectively illuminate the inflatable. The light fixture also includes several enhanced features which address the heat generation problems associated with large lumen light systems.

In accordance with: another feature of the present invention, the light fixture includes a light container or canister which is constructed of a semi-transparent or transparent material. One type of material is a high-impact, high heat-resistant plastic such as a polycarbonate material such as Lexan. However, other durable semi-transparent or transparent materials can be used. The durable material of the canister helps to protect the light fixture components from damage thereby increasing the life of the light fixture. The transparency of the material can be selected to control the amount of lumens generated by the lighting device. As can be appreciated, the material may be colored, have a colored coating painted or applied to the surface of the material so as to illuminate the inflatable by a particular colored light. The canister is designed to house the light source. The canister is preferably a cylindrically-shaped canister having a substantially uniform interior and exterior diameter. However, other canister shapes can be used for various types of applications.

In accordance with yet another feature of the present invention, the canister is sized to house other components of the light source. Preferably, the majority of the light fixture components, other than the canister and power source, are housed inside the canister. The incorporation of many of the components into the canister simplifies the installation and deinstallation of the light fixture.

In accordance with still another feature of the present invention, the canister is designed to allow a cooling fluid to pass through the canister so as to cool one or more components within the canister. Preferably, the cooling fluid is air and more preferably ambient air. Preferably, the canister provides a passageway to allow the cooling fluid to enter the bottom of the canister and exit out the top of the canister. As can be appreciated, the flow of the cooling fluid may be reversed and/or the cooling fluid may enter and/or exit at other areas on the canister.

In accordance with yet another feature of the present invention, the canister includes a top plate mounted on the top of the canister. Preferably the top plate is mounted so as to be spaced at some distance from the top edge of the canister. In one arrangement, the top plate is spaced from the top of the canister by use of brackets which are securely mounted to the top plate and the top section of the canister. However, other arrangements can be used to space the top plate from the top of the canister. As can be appreciated, the canister may include one or more openings in the top sides of the container as an alternative to or in combination with the space top plate. The space provided by the top plate can be substituted for or used in combination with slots in the top side of the canister. The top plate may also be designed to include openings. Such a top plate design allows the top plate to be spaced from or mounted on the top of the canister. The spacing of the top plate and/or openings in the top plate from the canister provides a passageway for a cooling fluid to enter or exit the canister. Preferably, the top plate is of the same material as the canister; however, other materials can be used. The top plate also has the function of reducing and/or preventing liquids or debris from inadvertently falling into the canister which may damage the light or other components of the light fixture in the canister. The openings of the canister may be covered by a mesh which allows a cooling fluid to pass through the mesh, but reduces or prevents debris, insects, liquid, etc. from inadvertently entering into the interior of the container. In one embodiment, the top plate may be or include a mesh such as a wire, plastic and/or fabric mesh. The top plate may preferably include a bracket or hook adapted to mount the top plate to an inflatable. In one embodiment, the inflatable includes a cord or chain attached to the interior of the inflatable. This cord or chain is then secured to the bracket or hook on the top plate thereby securing the light fixture in the interior of the inflatable.

In accordance with still yet another feature of the present invention, the illumination source of the light fixture is preferably an incandescent light source or a halide light source. Incandescent light sources typically require a larger wattage per lumen than halide light sources. If a large inflatable is to be illuminated, a halide light source is preferably used due to the lower wattage requirements and reduce amount of heat generated. Preferably, the light fixture includes a light socket adapted to be used with up to 1500 watt light sources. As can be appreciated, light sockets handling a larger wattage can be used if needed for a particular application. In one preferred embodiment, the light socket is positioned near the bottom end of the canister. In a particular embodiment, the light socket is spaced above the bottom end of the canister.

In accordance with another feature of the present invention, the base of the canister includes an opening adapted to allow fluid to flow into and/or out of the base of the container. The base of the canister may be mounted to the bottom end of the canister or mounted in a spaced relationship from the bottom end of the canister. Preferably, the opening in the base is positioned below the location of the light socket. In addition to or alternatively, an opening can be placed on the side of the light canister closely adjacent to the base of the light container. The opening in the base and/or sides of the canister allows fluid to enter or exit the light canister to cool the light when in operation. The base may be made of the same or a different material from the canister. As can be appreciated, the base may contain more than one opening. A mesh may be used to cover the openings in and/or form the base to prevent debris, insects, liquids and the like from entering the interior of the canister and adversely affecting the components in the canister.

In accordance with another feature of the present invention, the canister naturally cools the light source during operation. In one particular embodiment, the canister includes an opening at the top and bottom of the canister. These openings are preferably formed by the top plate and base of the canister. When utilizing this canister arrangement, a natural cooling action of the air about the light occurs due to the light heating the surrounding air and causing the air within the canister to rise and pass through the opening in the top of the light container. The passing of air out of the canister causes a pressure drop within the canister thereby resulting in cool air being drawn in through the base opening of the light container. As can be appreciated, such a canister design provides for natural cooling of the light in operation thereby reducing the temperature of the light and the light container during operation.

In accordance with another feature of the present invention, the cooling effects of the light canister can be enhanced by a fan blower positioned under the light socket to help draw air through the base of the canister and to blow the air onto the light. The blower is preferably mounted in a blower container which is designed to direct the air drawn through the base of the light container toward the light so as to maximize the cooling efficiency of the light. The blower may include a one speed or variable speed motor. In one embodiment, the blower includes a fan blade which blade is designed to draw air into the blower when the fan blade rotates.

In accordance with yet another feature of the present invention, the blower includes a diffusion surface which may be positioned on the top of the fan blade. The diffuser is designed to distribute air blown by the fan blade evenly about the light source so as to efficiently cool the light source. The diffuser preferably is a plate which includes multiple openings designed to direct air through the diffuser. In one preferable embodiment, the light socket is mounted to the center of the diffuser so as to increase the efficiency and uniformity of cooling of the light source.

In accordance with still yet another object of the present invention, a low heat producing high lumens light source is used. A 1000 watt metal halide bulb can produce approximately 117,000 lumens and a 400 watt metal halide bulb can produce approximately 36,000 lumen. These lights require a reduced wattage as compared to an incandescent light using 1500 watts and producing only 33,000 lumens. The reduction in wattage results in less energy consumption and significantly less heat generation. As can be appreciated, lower wattage lights which produce high lumens, such as halide lights and the like can be naturally cooled without use of a blower fan. Higher wattage bulbs such as 400–1500 watt bulbs can be cooled by a relatively small blower fan. In one particular embodiment, a blower including a fan blade of approximately 4 inches in diameter is able to maintain the light fixture temperature within about 20 to 80° above ambient temperature. This temperature range allows the light fixture to be easily handled if necessary even after a long use. Furthermore, the light fixture is cooled to a sufficiently low temperature so as to reduce the chances of damage to the inflatable if the surface of the inflatable during operation and/or if the inflatable surface inadvertently comes in contact with the light container.

In accordance with another feature of the present invention, the light fixture may include a temperature sensor which monitors the temperature within the canister. The temperature sensor may be connected to the blower and be designed to activate the blower when a particular temperature threshold within the interior of the light container has been reached. A temperature monitor may also be connected to the blower in such a manner so as to increase or reduce the velocity of the blower in response to the monitored temperature within the container. In addition to or in alternative thereof, the temperature monitor may be connected to the light to act as a safety switch which shuts off the light when a particular temperature threshold within the light container has been reached.

In accordance with yet another feature of the present invention, a power source is associated with the light fixture which is adapted to generate a sufficient power source to light in a particular type of light bulb within the light fixture. For 400 and 1000 watt metal halide lights, a specially designed power source typically is used to generate enough power to energize such lights. The power source may be adapted to be plugged into a standard electrical outlet and may include a transformer or the like to convert the power from a typical electrical socket into the needed power to illuminate the light. For convenience, the transformer may be sealed in a durable container which is substantially water and/or air tight so as to reduce damage to the internal components of the transformer and may further include a handle to conveniently move the transformer to a particular location. Special quick connectors may be designed for quick attachment and detachment of the power cord from the light fixture to the transformer for ease of installation. The base of the canister preferably includes an opening to allow the power cord to enter the canister and supply the light source with power. In one embodiment the base includes a cable locking arrangement to secure the cable in place in the cable opening in the base. The cable locking arrangement prevents the wiring inside the canister from being damaged during installation and deinstallation of the light fixture. It is the primary object of the present invention to provide an illuminating source for an inflatable object.

In accordance with another aspect of the present invention, a light impairing material is mounted and/or positioned about the canister. The material is designed to control the amount of light radiating from the light fixture. In one particular arrangement, the material includes sections which block and/or impair the passage of light through the material. In another particular arrangement, the material causes words and/or images to be formed on the interior of the inflatable. In one preferred embodiment, the material is a plastic material mounted to be stationary and/or rotatable relative to the canister. The plastic material includes sections such as painted, dyed, laminated, colored sections which cause images to form on the interior of the inflatable when the light bulb is illuminated. As can be appreciated, the canister itself can be painted, dyed, colored or otherwise covered to form images on the interior of the inflatable. In another particular embodiment, a motor can be used to move the light impairing material about the canister.

It is a principal object of the present invention to provide an illumination source for an inflatable structure.

It is another object of the present invention to provide an illuminating system which includes a light cooling system to dissipate the heat generated by the illuminating system.

It is yet another object of the present invention to provide an illuminating system which can be conveniently mounted on or within an inflatable structure.

It is still yet another object of the present invention to provide an illuminating system which can generate one or more colors thereby illuminating an inflatable in a particular color.

It is another object of the present invention to provide an illuminating system which is durable and lightweight.

It is still another object of the present invention to provide an illuminating system which is designed to naturally cool the light source.

It is still yet another object of the present invention to provide an illuminating system which directs a cooling fluid about a light source to thereby efficiently and effectively cool the lighting source.

It is yet another object of the present invention to provide an illuminating system which includes a diffuser to direct a cooling fluid substantially uniformly about the lighting source to thereby efficiently and effectively cool the lighting source.

It is still another object of the present invention to provide an illuminating system which includes a light source that produces a high quantity of lumens, low heat generation and low wattage usage.

It is another object of the present invention to provide an illuminating system which prevents unwanted materials from entering into the interior of the light system.

It is still another object of the present invention to provide an illuminating system including a blower to direct cool air onto the light source.

It still yet another object of the present invention to provide a light system which monitors the temperature of the light source and adjusts the rate of cooling of the light source and/or deactivates the light source upon detecting a certain temperature.

It is still yet another object of the present invention to provide a power source for the lighting system which is durable and can be easily assembled and dissembled from the light source.

These and other objects and advantages will become apparent to those skilled in the art upon reading and understanding the following detailed description of the various embodiments of the invention.

BRIEF DESCRIPTION OF THE DRAWINGS

Reference may now be had to the drawings, which illustrate various embodiments that the invention may take in physical form and in certain parts and arrangements of parts wherein.

DESCRIPTION OF THE PREFERRED EMBODIMENTS

Figure 1:
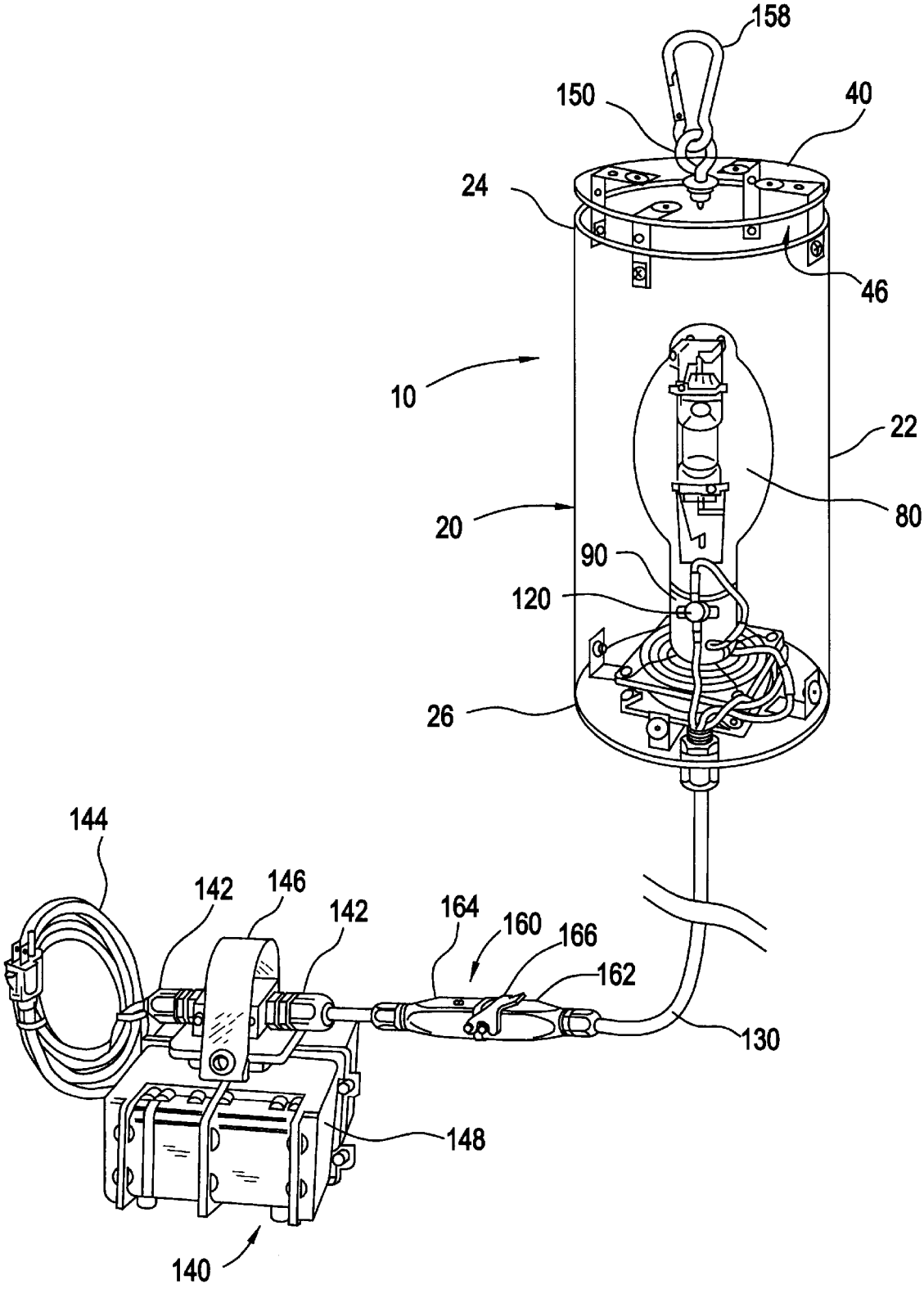
FIG. 1 is a perspective view of the light system of the present invention.
Figure 2:
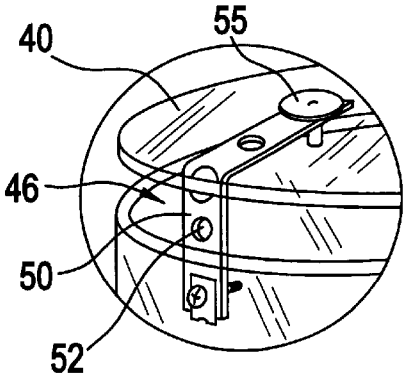
FIG. 2 is an enlarged perspective view of the top edge of the light system shown in FIG. 1.
Figure 3:
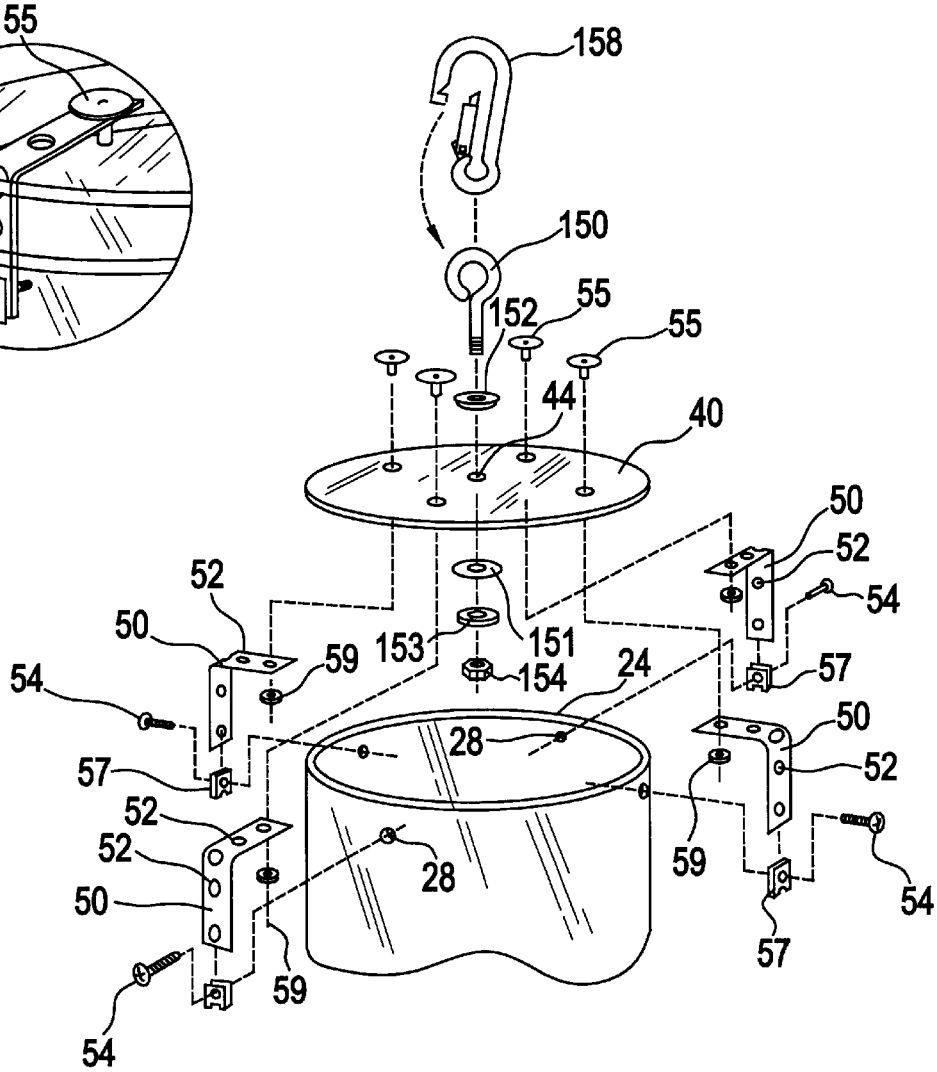
FIG. 3 is an exploded perspective view of the top section of the light system shown in FIG. 1.

Referring now to the preferred embodiment of the invention only and not for the purpose of limiting the same, FIGS. 1–5 illustrate a light system 10 which is designed to illuminate an inflatable structure. Light system 10 includes a canister 20 which is cylindrical in shape and includes side wall 22, a top edge 24 and a bottom edge 26. Canister 20 is made of a transparent material made of a durable high impact, high heat resistant material such as a polycarbonate material. Referring now to FIGS. 1–3, a circular top plate 40 is connected to the top portion of canister 20. Top plate 40 is spaced from top edge 24 of canister 20 and is connected to canister 20 by the use of top brackets 50. Top brackets 50 include a plurality of bracket holes 52 to adjust the distance top plate 40 is secured from the top edge 24 of canister 20. The space between top edge 24 and top plate 40 defines a top opening 46. Top brackets 50 are connected to the interior surface of side wall 22 by bracket screws 54 being inserted through bracket holes 52 of top bracket 50 and into openings 28 of side wall 22 of canister 20. Bracket screws 54 are secured in place by clip nuts 57 which are clipped to the ends of brackets 50. Similarly, top brackets 50 are connected to top plate 40 by inserting bracket rivets 55 through bracket hole 52 and into bracket openings 42 of top plate 40. Bracket rivots 55 are secured by washer 59. Top plate 40 is preferably a transparent material which is similar in composition to the material used in canister 20.

Top plate 40 includes a hook opening 44 adapted to receive the end of hook 150. Hook 150 is secured into hook opening 44 of top plate 40 by the use of a washers 151, 152, 153 and a hook bolt 154 which is threaded onto the end of hook 150. Connected to the eye of hook 150 is lock clip 158 to hook 150. Lock clip 158 is designed to be clipped to a hook, chain or other fastening area on an inflatable thereby attaching light system 10 to an inflatable.

Figure 4:
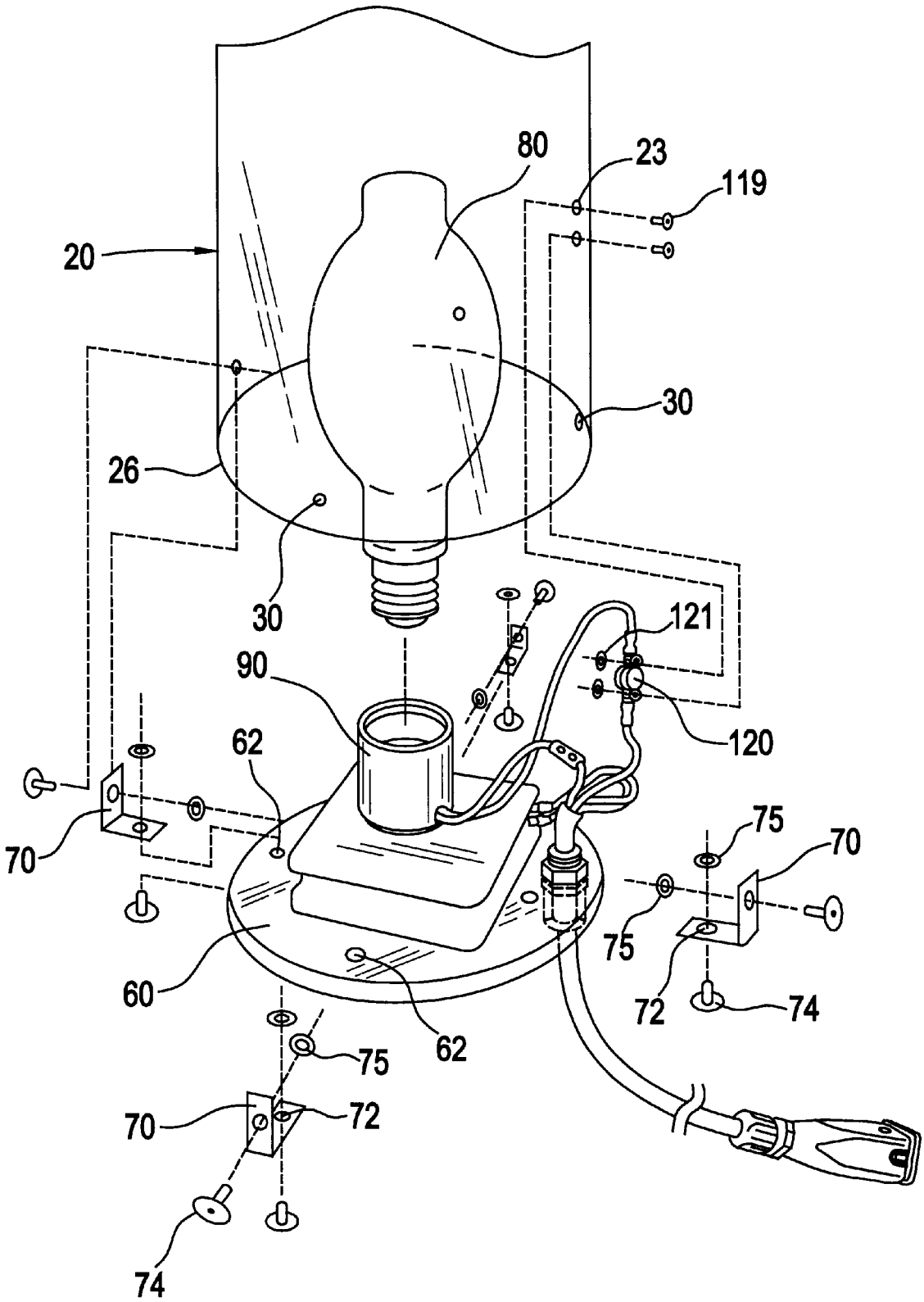
FIG. 4 is an exploded perspective view of the bottom section of the light system shown in FIG. 1.

Referring now to FIGS. 1 and 4, canister 20 also includes a circular base plate 60 which is secured to the bottom edge 26 canister 20. Base plate 60 is a transparent material similar in composition to the composition used in canister 20. As shown in FIG. 1, base plate 60 is secured to canister 20 so that the base plate substantially abuts against bottom edge 26 of canister 20. Base plate 60 is secured to canister 20 by the use of bottom brackets 70. Bottom brackets 70 include bracket holes 72 which are designed to be aligned with bottom bracket openings 30 on canister 20 and bracket opening 62 on base plate 60. Bracket rivots 74 are inserted through bracket holes 72 and into openings 30 on canister 20 and opening 62 on base plate 60 and secured in place by washers 75 thereby securing base plate 60 to canister 20.

Figure 5:
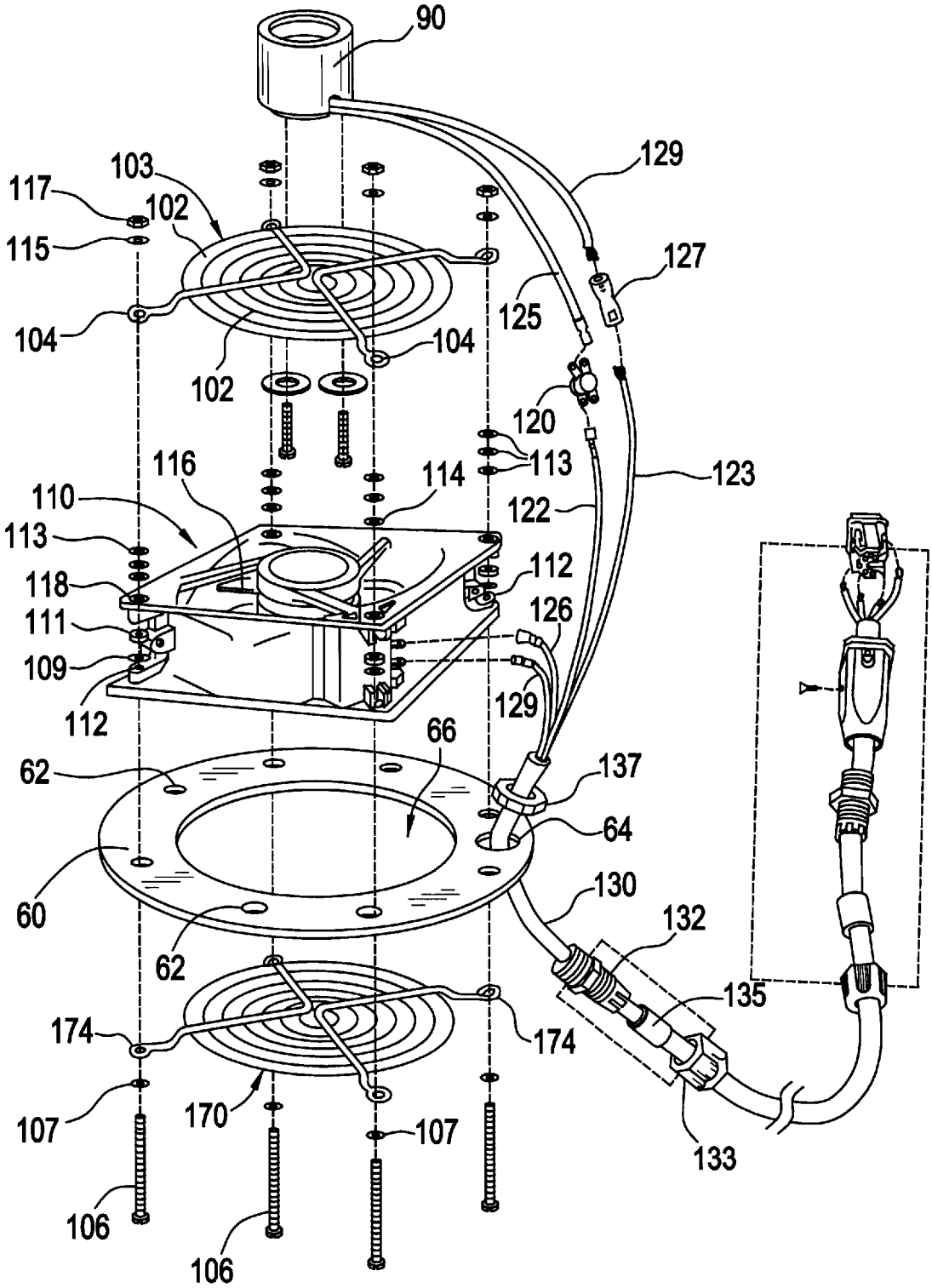
FIG. 5 is an exploded perspective view of the fan housing shown in FIG. 1.

Referring now to FIGS. 4 and 5, base plate 60 includes a base opening 66 positioned substantially in the center of base plate 60. Base plate 60 also includes a power cord opening 64 positioned adjacent to base opening 66. As shown in FIG. 5, power cord opening 64 provides an opening whereby power cord 130 can be inserted through base plate 60. A cord lock 132, lock bolt 133, nut 137 and compressor 135 are designed to be threaded into cord opening 64 and to lock power cord 130 in position relative to base plate 60 so as to prevent power cord 130 from moving within cord opening 64.

As shown in FIGS. 1 and 4, a light bulb 80 is positioned in the interior of canister 20. Light bulb 80 is designed to provide illumination when supplied with power. Preferably light bulb 80 is a metal halide light. The type of metal halide light and the operation of metal halide light are well known in the art and will not be described further. As shown in FIG. 1, light bulb 80 is secured into place in light socket 90. In one arrangement, light bulb 80 is screwed into light socket 90. Light socket 90 is in turn secured to the top of diffuser 100. As shown in FIG. 1, light socket 90 is positioned substantially in the center of diffuser 100.

Diffuser 100 includes a plurality of diffuser openings 102. As shown in FIG. 1, diffuser openings 102 are arcuate in shape and are positioned about, light socket 90 at various intervals from the peripheral edge of the diffuser 100. Diffuser 100 includes mount openings 104 which openings are aligned with top openings 118 on blower housing 110.

Blower housing 110 includes a central cavity wherein a motor 114 and a fan 116 are positioned therein. Blower housing 110 also includes mount openings 112 used to secure blower housing 110 to the inner surface of base plate 60. A lower diffuser 170 having a plurality of arcuate openings 172 is positioned over opening 66. Lower diffuser 170 is secured to base plate by mount openings 174. Mount screws 106 are inserted through mount openings 174 and washers 107 to secure lower diffuser 170 to the bottom of base plate 60. Mount screws are designed to pass through mount openings 112 of housing 110 to securing housing 110 to the bottom interior of base plate 60. Washers 109 and nuts 111 securing the housing in place relative to base plate 60. Mount screw 106 also secures diffuser 100 to the top of housing 110 by passing through three washers 113 and through mount openings 104 of diffuser 100. Washers 115 and bolts 117 securing diffuser 100 in place.

Attached to the side of canister 20 is a temperature monitor 120. Temperature monitor 120 is mounted to canister 20 by rivots 119 passing through openings 23 in side 22 and being secured in place by washer 121. Temperature monitor 120 is connected to wire 122 from power cord 130. Wires 124 and 126 from power cord 130 provide energy to motor 114 and wires 122 and 123 from power cord 130 provide energy for light bulb 180. Wire 125 is connected between light socket 90 and temperature monitor 120. Wire 129 from light socket 90 is connected to wire 123 by clip 127.

Transformer 140 provides the required power to light bulb 80 and motor 114. The end of power cord 130 includes a connector 160 to allow an operator to easily connect and disconnect the end of power cord 130 from transformer 140. Connector 160 includes two plugs 162, 164 which form a positive connection to the four wires in power cord 130. A latch 166 is designed to secure the two plugs together. The end of plug 164 includes a quick connect 142 which is designed to be easily secured to transformer 140. Transformer 140 also includes a source power cord 144. Source power cord 144 includes a quick connect 142 to enable an operator to quickly connect and disconnect one end of the power cord 144 from transformer 140. The other end of power cord 144 is designed to be plugged into a standard electrical outlet. Transformer 140 also includes a handle 146 to allow an operator to easily carry and position transformer 140 to a desired location. Transformer 140 also includes a casing 148 designed to protect the components of the transformer from adverse ambient conditions. The general components of transformer 140 which produce the desired voltage and current to energize light bulb 80 and motor 114 are well known in the art and will not be further described.

In one particular embodiment, canister 20 is constructed out of a low weight, high impact, high heat resistant Lexin. Top plate 40 is mounted approximately one inch above the top edge 24 of canister 20. Top plate 40 is also made of Lexin. The top plate is designed to act as a rain shield to prevent moisture from entering the interior of canister 20 thereby preventing moisture to come in contact with light bulb 80 which could in turn cause damage to light bulb 80. Base plate 60 is also made of Lexin and has a blower housing 110 mounted to the interior surface of the base plate. The fan 116 within blower housing 110 is a four inch diameter blade impeller. The fan is designed to draw air through lower diffuser 170 and base opening 66 and force air through diffuser openings 102 of diffuser 100 to cool light bulb 80 during operation. The air upon passing light bulb 80 is then expelled from canister 20 by passing through top opening 46. This arrangement has been found to maintain the temperature of the canister so that it is cool enough to be handled with human hands even after a long duration of operation. Typically the temperature of the canister is merely 40° above ambient temperatures which the light bulb is energized. The temperature monitor 120 is used to monitor the temperature within the canister and to deactivate light bulb 80 upon detection of the temperature above a predetermined level by breaking the circuit between wires 122 and 125. The deactivation of the light bulb prevents canister 20 from becoming too hot if the fan should fail to operate or if the inflatable deinflates and comes in contact with canister 20 thereby plugging up base opening 66 and/or top opening 46. In one design, temperature monitor 120 shuts down light bulb 80 when the temperature of canister 20 is detected to be 50–80° above ambient temperature. The light bulb is a 400 watt metal halide bulb or a 100 watt metal halide bulb. The 400 watt bulb is designed to produce 36,000 lumens (FLC-400) and the 100 watt bulb is designed to produce 117,000 lumens (FLC-1000).

In another embodiment, the light system 10 includes the design as mentioned above. The light system further includes the temperature monitor 120 to be wired to motor 114 to thereby activate motor 114 when a threshold temperature within canister 20 is reached and/or to deactivate motor 114 when the temperature within canister 120 falls below a threshold temperature. In a further embodiment, motor 114 is a variable speed motor whereby the speed of the rotating fan is a function of the detected temperature within canister 20.

In a further embodiment, light system 10 includes a mesh which is positioned about top opening 46 and/or base opening 66. The mesh is designed to prevent debris, insects or other unwanted materials from inadvertently entering into the interior of canister 20 and adversely affecting one or more of the internal components in canister 20. The mesh may be made up of a fabric, plastic and/or wire material and connected to canister 20 by bolts, screws, adhesive, tacks, brackets, bands or the like. Mesh is air permeable so as not to adversely affect the flow of air into and/or out of canister 20.

The invention has been described with reference to a preferred embodiment and alternates thereof, it is believed that many modifications and alterations of the embodiment disclosed will readily suggest itself to those skilled in the art upon reading and understanding the description of the invention in combination with the drawings. It is intended to include all such modifications and alterations insofar as they come within the scope of the present invention.

I claim:

1. A light fixture comprising:

a. a light container having a base portion, a top portion and a top plate, said top plate being spaced from a top edge of a body portion of the light container to form at least one upper passageway;

b. a light socket positioned in said light container between said base portion and said top portion to accommodate a light source, said light source at least partially directing light toward said top portion of said container; and c. a cooling arrangement to cool said light source in said light container, said cooling arrangement including at least one lower passageway, said at least one upper passageway and a diffuser, said at least one lower passageway allowing a cooling fluid to enter the interior of said light container at a location below said diffuser and said light source, said at least one upper passageway positioned above said light source and allowing cooling fluid which passes through said diffuser and subsequently passes by said light source to exit said light container, said diffuser positioned between said at least one lower passageway and said light source, said diffuser including a plurality of diffusion slots spaced from an outer edge of and concentrically oriented about the center of said diffuser, said diffusion slots adapted to direct cooling fluid that passes through said diffusion slots onto said light source.

2. The light fixture as defined in claim 1, wherein said cooling arrangement includes a blower, said blower positioned between said at least one lower passageway and said diffuser, said blower drawing said cool fluid through said at least one lower passageway and into said container and at least partially blowing said cooling fluid through said at least one diffuser slot in said diffuser, and toward said light source.

3. The light fixture as defined in claim 2, wherein said blower directing at least a majority of said cooling fluid through said at least one diffusion slot in said diffuser.

4. The light fixture as defined in claim 3, wherein said blower includes an electric fan.

5. The light fixture as defined in claim 4, wherein said light socket is connected to a top surface of said diffuser.

6. The light fixture as defined in claim 5, wherein said cooling arrangement includes a temperature monitor to monitor the temperature in said light container, said temperature monitor including a blower control to activate a blower upon detecting a predetermined temperature in said light container.

7. The light fixture as defined in claim 6, wherein said cooling arrangement includes a temperature monitor to monitor the temperature in said light container, said temperature monitor including a blower control to activate a blower upon detecting a predetermined temperature in said light container.

8. The light fixture as defined in claim 7, including a container temperature monitor to monitor the temperature inside said light container, said container temperature monitor deactivating said light source upon detecting a predetermined temperature in said light container.

9. The light fixture as defined in claim 8, wherein said light container is at least semi-transparent.

10. The light fixture as defined in claim 9, wherein said light container includes a top plate, said top plate being spaced from a top edge of said light container, said space between said top plate and said top edge of said light container at least partially forming said at least one upper passageway.

11. The light fixture as defined in claim 10, wherein said light container includes a fluid permeable protector material, said protector material positioned over an opening selected from the group consisting of said lower passageway, said upper passageway and combinations thereof, said fluid permeable protector material inhibiting foreign objects from entering the interior of said container, said foreign objects including objects selected from the group consisting of debris, insects, and combinations thereof.

12. The light fixture as defined in claim 11, wherein said light container includes a connector to secure said light fixture to the interior of an inflatable object.

13. The light fixture as defined in claim 12, including a light impairing material removably connected to the exterior surface of said light container said light impairing material reducing the amount of light passing through said material.

14. The light fixture as defined in claim 13, including a power source, said power source including a transformer housed in a protective casing, a power cord for suppling power from said transformer to said light socket, one end of said power cord passing through a cord opening in said base plate and being secured into position in said base by a cord securing means, another end of said power cord including a fastener to easily connect and disconnect said another end from said transformer.

15. The light fixture as defined in claim 2, wherein said blower includes an electric fan.

16. The light fixture as defined in claim 2, wherein said blower is connected to a bottom surface of said diffuser.

17. The light fixture as defined in claim 2, including a container temperature monitor to monitor the temperature inside said light container, said container temperature monitor deactivating said light source upon detecting a predetermined temperature in said light container.

18. The light fixture as defined in claim 2, wherein said light container includes a fluid permeable protector material, said protector material positioned over an opening selected from the group consisting of said lower passageway, said upper passageway and combinations thereof, said fluid permeable protector material inhibiting foreign objects from entering the interior of said container, said foreign objects including objects selected from the group consisting of debris, insects, and combinations thereof.

19. The light fixture as defined in claim 2, including a light impairing material removably connected to the exterior surface of said light container, said light impairing material reducing the amount of light passing through said material.

20. The light fixture as defined in claim 1, wherein said light socket is connected to a top surface of said diffuser.

21. The light fixture as defined in claim 1, wherein said cooling arrangement includes a temperature monitor to monitor the temperature in said light container, said temperature monitor including a blower control to activate a blower upon detecting a predetermined temperature in said light container.

22. The light fixture as defined in claim 21, wherein said blower control includes a controller to vary the speed of said blower as a function of the temperature in said light container.

23. The light fixture as defined in claim 1, including a container temperature monitor to monitor the temperature inside said light container, said container temperature monitor deactivating said light source upon detecting a predetermined temperature in said light container.

24. The light fixture as defined in claim 1, wherein said light container is at least semi-transparent.

25. The light fixture as defined in claim 24, including a light impairing material removably connected to the exterior surface of said light container, said light impairing material reducing the amount of light passing through said material.

26. The light fixture as defined in claim 1, wherein said light container includes a top plate, said top plate being spaced from a top edge of said light container, said space between said top plate and said top edge of said light container at least partially forming said at least one upper passageway.

27. The light fixture as defined in claim 26, wherein said light container includes a fluid permeable protector material, said protector material positioned over an opening selected from the group consisting of said lower passageway, said upper passageway and combinations thereof, said fluid permeable protector material inhibiting foreign objects from entering the interior of said container, said foreign objects including objects selected from the group consisting of debris, insects, and combinations thereof.

28. The light fixture as defined in claim 1, wherein said light container includes a fluid permeable protector material, said protector material positioned over an opening selected from the group consisting of said lower passageway, said upper passageway and combinations thereof, said fluid permeable protector material inhibiting foreign objects from entering the interior of said container, said foreign objects including objects selected from the group consisting of debris, insects, and combinations thereof.

29. The light fixture as defined in claim 1, wherein said light container includes a connector to secure said light fixture to the interior of an inflatable object.

30. The light fixture as defined in claim 1, including a light impairing material removably connected to the exterior surface of said light container, said light impairing material reducing the amount of light passing through said material.

31. A light fixture used to at least partially illuminate an object comprising:

a. a light container having a body portion, a top plate and a base plate, said body portion being at least semi-transparent, said top plate being spaced from a top edge of said body portion to form an upper passageway, said base plate including at least one air passageway;

b. a blower positioned inside said body portion of said light container, said blower including a blower housing, a motor and a fan blade, said blower housing including a central cavity positioned over said at least one air passageway of said base plate, said fan blade positioned in said central cavity of said blower housing, said fan blade rotatable in said blower housing to at least partially draw air though said air passageway in said base plate and to at least partially blow said air through said upper passageway;

c. a diffuser connected to said blower, said diffuser including a plurality of diffusion slots spaced from an outer edge of said diffuser, said diffusion slots causing air blown toward said diffuser by said blower to be at least partially directed onto a light source in said light container;

d. a light socket positioned between said diffuser and said upper passageway, said light socket adapted to accommodate said light source; and, e. a connector to connect said light container to said object.

32. The light fixture as defined in claim 31, wherein said plurality of diffusion slots are concentrically oriented about the center of said diffuser.

33. The light fixture as defined in claim 32, wherein said light socket is connected to a top surface of said diffuser.

34. The light fixture as defined in claim 33, wherein said blower directing at least a majority of said air through said at least one diffusion slot in said diffuser.

35. The light fixture as defined in claim 34, including a container temperature monitor to monitor the temperature inside said light container, said container temperature monitor deactivating said light source upon detecting a predetermined temperature in said light container.

36. The light fixture as defined in claim 35, wherein said container temperature monitor including a blower control to activate a blower upon detecting a predetermined temperature in said light container.

37. The light fixture as defined in claim 36, wherein said blower control includes a controller to vary the speed of said blower as a function of the temperature in said light container.

38. The light fixture as defined in claim 37, including a light impairing material removably connected to the exterior surface of said light container, said light impairing material reducing the amount of light passing through said material.

39. The light fixture as defined in claim 38, including a power source, said power source including a transformer housed in a protective casing, a power cord for suppling power from said transformer to said light socket, one end of said power cord passing through a cord opening in said base plate and being secured into position in said base by a cord securing means, another end of said power cord including a fastener to easily connect and disconnect said another end from said transformer.

40. The light fixture as defined in claim 31, wherein said light socket is connected to a top surface of said diffuser.

41. The light fixture as defined in claim 31, wherein said blower directing at least a majority of said air through said at least one diffusion slot in said diffuser.

42. The light fixture as defined in claim 31, including a container temper ature monitor to monitor the temperature inside said light container, said container temperature monitor deactivating said light source upon detecting a predetermined temperature in said light container.

43. The light fixture as defined in claim 31, including a light impairing material removably connected to the exterior surface of said light container, said light impairing material reducing the amount of light passing through said material.

* * * * *